US006189775B1

(12) United States Patent
Wu

(10) Patent No.: US 6,189,775 B1
(45) Date of Patent: Feb. 20, 2001

(54) PACKING BOX

(76) Inventor: Yin-Yin Wu, No. 2, Lane 9, Chin Fu Street, Chutung Town, Hsinchu Hsien (TW)

( * ) Notice: Under 35 U.S.C. 154(b), the term of this patent shall be extended for 0 days.

(21) Appl. No.: 09/482,070

(22) Filed: Jan. 13, 2000

(51) Int. Cl.[7] ..... B65D 5/42
(52) U.S. Cl. ..... 229/103; 206/457; 229/116.1
(58) Field of Search ..... 229/103, 116.1; 206/457; 273/287; 446/75, 77

(56) References Cited

U.S. PATENT DOCUMENTS

| | | | | |
|---|---|---|---|---|
| 1,189,598 | * | 7/1916 | McLean | 229/116.1 |
| 1,662,899 | * | 3/1928 | Ridgway et al. | 229/103 |
| 3,065,847 | * | 11/1962 | Borden | 206/457 |
| 3,375,008 | * | 3/1968 | Atkinson | 229/103 |
| 3,590,500 | * | 7/1971 | Smith | 206/457 |
| 4,548,352 | * | 10/1985 | Capo et al. | 229/116.1 |
| 4,815,607 | * | 3/1989 | Agapiou | 206/457 |
| 5,054,611 | * | 10/1991 | Russomanno et al. | 206/457 |
| 5,201,660 | * | 4/1993 | Copen et al. | 446/75 |
| 5,394,989 | * | 3/1995 | Delson | 206/457 |
| 5,542,870 | * | 8/1996 | Westersund | 446/75 |
| 5,839,937 | * | 11/1998 | Thomas | 446/75 |
| 6,021,941 | * | 2/2000 | Schultz | 229/103 |
| 6,059,179 | * | 5/2000 | Giampapa | 229/103 |

* cited by examiner

*Primary Examiner*—Gary E. Elkins
(74) *Attorney, Agent, or Firm*—Rosenberg, Klein & Lee

(57) ABSTRACT

The present invention relates to a packing box transformable to real scenery display table mainly having two connectable cases inside of which an accommodation space is disposed in order to receive and fix all kinds of objects; accordingly, a basic structure of the packing box is created and characterized in that the surfaces of the two cases of the packing box are respectively provided with real scenery plain patterns corresponding to accommodated objects; locating surfaces for receiving the objects are disposed at pre-arranged position; moreover, when the two cases with downward opening are connected on a basic surface, the packing box is developed to a real scenery display table so that the objects accommodated inside can be located on the pre-arranged locating surfaces to create a three-dimensional effect.

3 Claims, 4 Drawing Sheets

PACKING BOX

BACKGROUND OF THE INVENTION

1. Field of the Invention

The present invention relates to an improvement of the packing box, and more particularly, to a packing box transformable to a real scenery display table.

2. Description of the Prior Art

Most of the conventional packing boxes have only the storage function so that the packing boxes are discarded when the objects inside are taken out. Therefore, it causes an unnecessary waste. In addition, many objects after taking out from the packing box require another display table to be placed upon for product demonstration and watching enjoyment. Accordingly, these kinds of products need an additional display table; however, the display table has a large volume, and this is unfavorable for packaging and transport. Moreover, the cost will be raised.

SUMMARY OF THE INVENTION

It is a primary object of the present invention to provide a packing box which is transformable to a real scenery display table in order to reduce the transport volume and to facilitate the carrying.

It is a further object of the present invention to provide a packing box which is transformable to a real scenery display table in order to reach a recycling goal and to reduce the cost.

BRIEF DESCRIPTION OF THE DRAWINGS

The drawings disclose illustrative embodiments of the present invention which serve to exemplify the various advantages and objects hereof, and are as follows.

DETAILED DESCRIPTION OF THE PREFERRED EMBODIMENT

Figure 1:
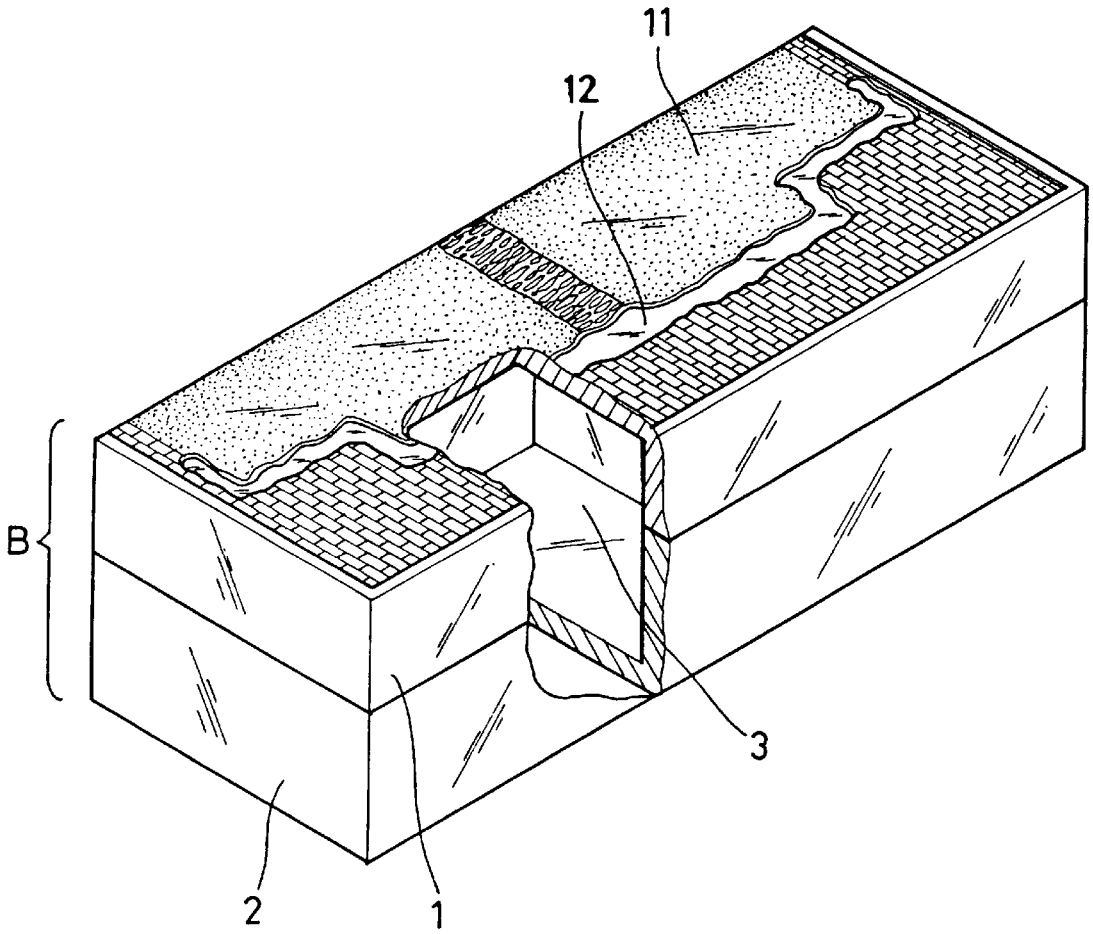
FIG. 1 is a perspective view of the front side of the present invention.
Figure 2:
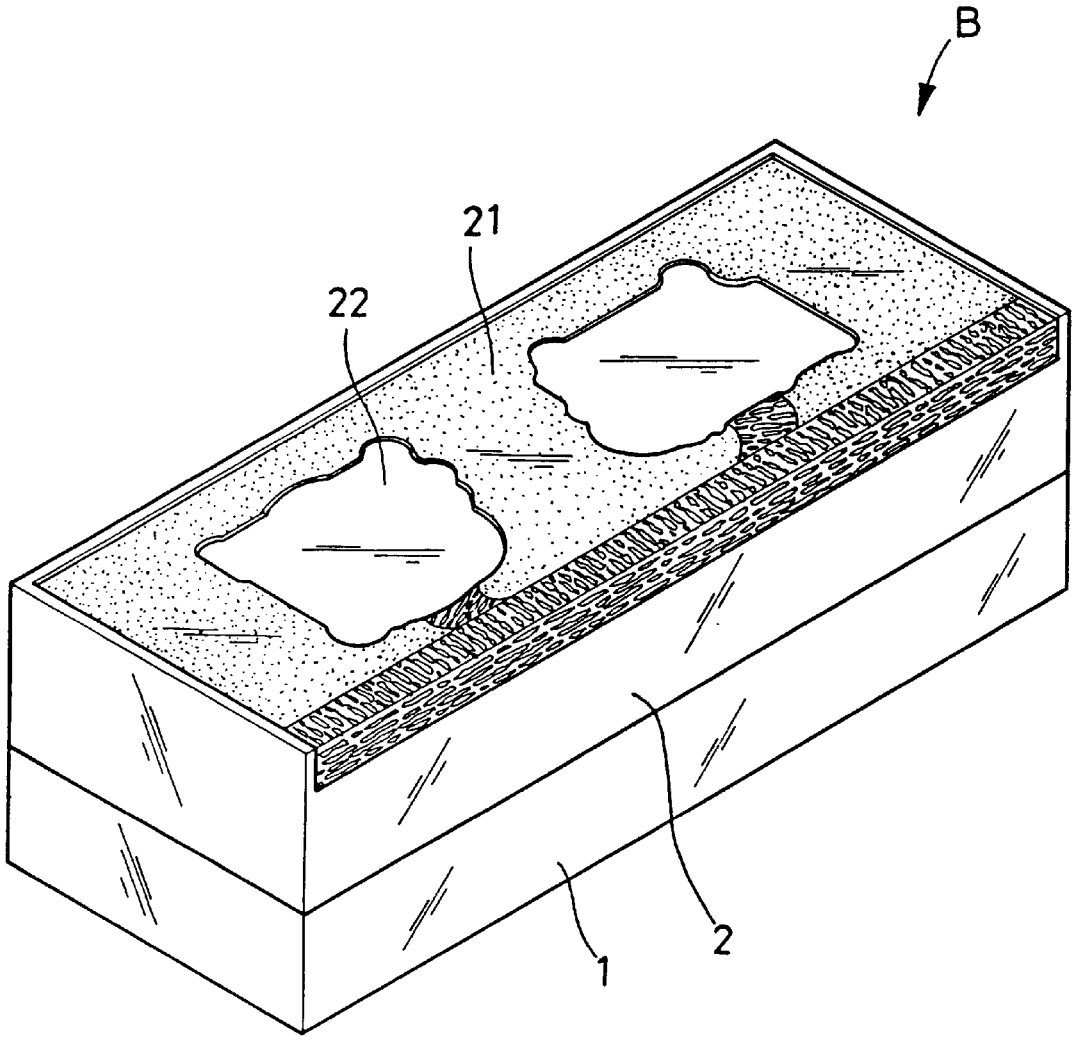
FIG. 2 is a perspective view of the rear side of the present invention.
Figure 3:
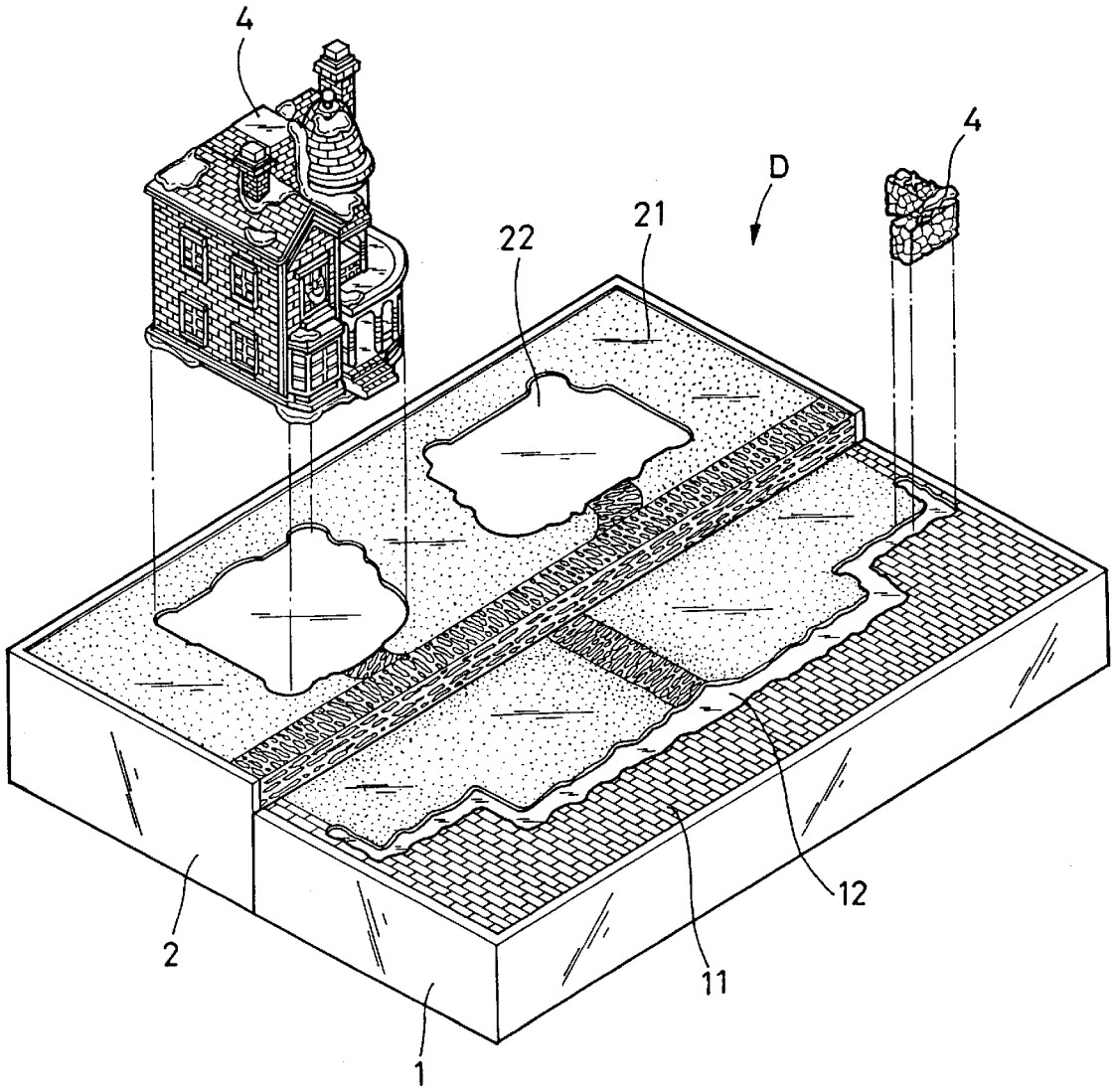
FIG. 3 is a perspective view of the structure of the present invention.
Figure 4:
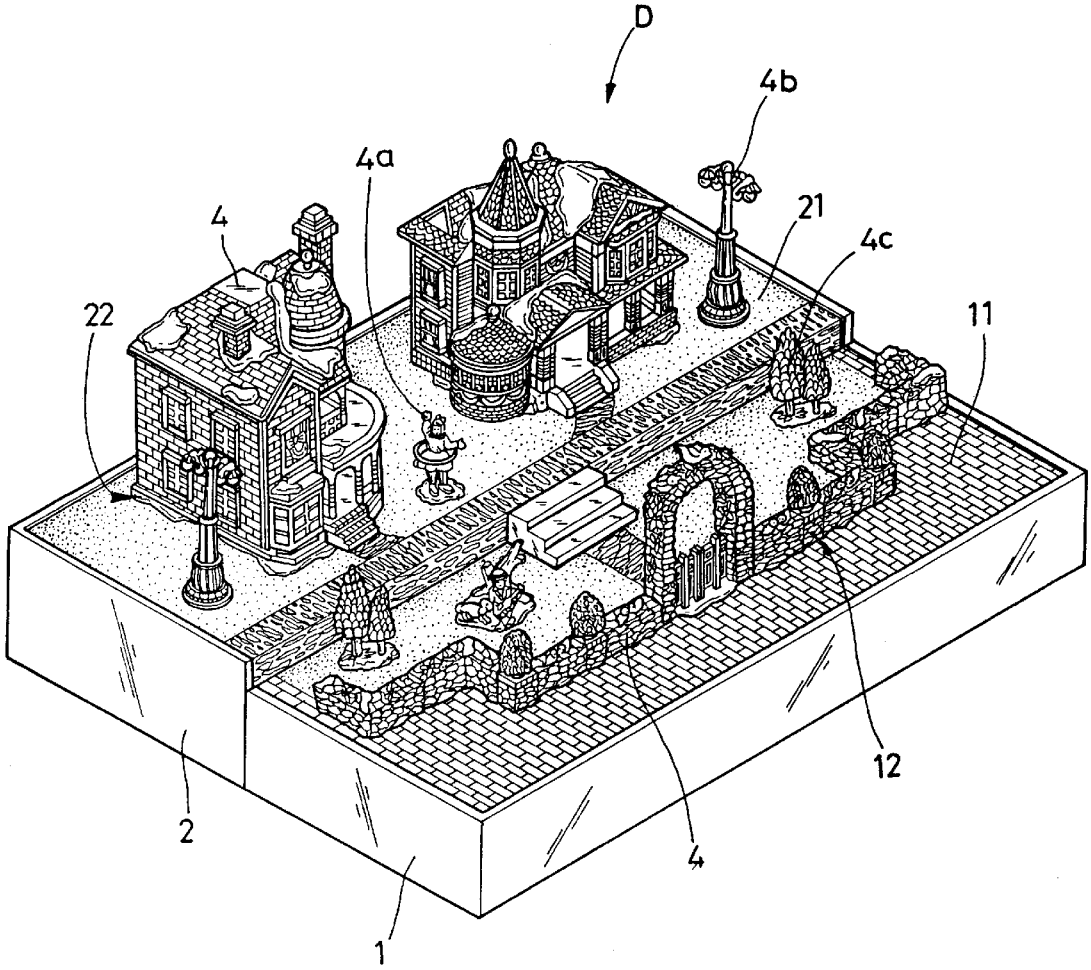
FIG. 4 is an application example of the present invention.

First of all, referring to FIG. 1 through 4, the packing box transformable to real scenery display table in accordance with the present invention includes two connectable cases 1, 2 inside of which an accommodation space 3 is disposed in order to receive and fix all kinds of objects; accordingly, a basic structure of the packing box (B) is created and characterized in that the surfaces of the two cases 1, 2 of the packing box (B) are respectively provided with real scenery plain patterns 11, 21 corresponding to accommodated objects 4; locating surfaces 12, 22 for receiving the objects 4 are disposed at pre-arranged positions; moreover, when the two cases 1, 2 with downward opening are connected on a basic surface, the packing box (B) is developed to a real scenery display table (D) so that the objects 4 accommodated inside can be located on the pre-arranged locating surfaces 12, 22 to create a three-dimensional effect.

Furthermore, the real scenery plain patterns 11, 21 can be directly printed on the surfaces of the two cases 1, 2, or stuck thereto.

Again, the locating surfaces 12, 22 are created in accordance with the form of the objects 4, and they can be made in slotted shape in order to stably fix the objects 4.

Certainly, a plurality of attached objects (4*a*, 4*b*, 4*c*) can be freely placed without fastening and reach the goal of various changes.

By means of the above-mentioned structure, the packing box (B) in accordance with the present invention is advantageous for transporting and carrying in addition to accommodating and fixing the objects 4. After reaching the delivery place, the packing box can be immediately used as a real scenery display table (D). Thus, not only can the material volume be greatly saved, but also one object with two functions so that its economic efficiency and convenience can be fully achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A packing box transformable to real scenery display table mainly comprising two connectable cases inside of which an accommodation space is disposed in order to receive and fix all kinds of objects; accordingly, a basic structure of said packing box is created and characterized in that the surfaces of said two cases of said packing box are respectively provided with real scenery plain patterns corresponding to accommodated objects, and locating surfaces for receiving said objects are disposed at pre-arranged positions; moreover, when said two cases with downward opening are connected on a basic surface, said packing box is developed to a real scenery display table so that said objects accommodated inside can be located on said pre-arranged locating surfaces to create a three-dimensional effect.

2. The packing box as claimed in claim 1, wherein said real scenery plain patterns can be printed or stuck on the surfaces of said cases.

3. The packing box as claimed in claim 1, wherein said locating surfaces are created in accordance with the form of said objects, and they can be made in slotted shape.

* * * * *